US005685185A

United States Patent [19]

MacDonald

[11] Patent Number: 5,685,185

[45] Date of Patent: Nov. 11, 1997

[54] KEY HOLDER

[76] Inventor: Sumner B. MacDonald, 285 N. Farm Dr., Bristol, R.I. 02809

[21] Appl. No.: 640,183

[22] Filed: Apr. 30, 1996

[51] Int. Cl.[6] ..... A47G 29/10

[52] U.S. Cl. ..... 70/459; 70/456 R; D3/207

[58] Field of Search ..... 70/456 R–459; D3/207, 212; 24/3.6, 3.11, 265 EC, 265 H

[56] References Cited

U.S. PATENT DOCUMENTS

| | | | |
|---|---|---|---|
| D. 306,799 | 3/1990 | Colan | D3/207 |
| D. 359,844 | 7/1995 | MacDonald | D3/207 |
| D. 359,845 | 7/1995 | MacDonald | D3/207 |
| 2,232,668 | 2/1941 | Schupbach | 70/459 |
| 2,435,152 | 1/1948 | Morse | 70/459 |
| 2,527,457 | 10/1950 | Schupbach | 70/459 |
| 3,345,713 | 10/1967 | Gaupp | 24/3.6 X |
| 3,516,272 | 6/1970 | Modrey | 70/459 |
| 4,324,121 | 4/1982 | Richter | 70/459 |
| 4,391,113 | 7/1983 | Jorgens | 70/459 |
| 4,474,043 | 10/1984 | Morrone, III | 70/456 R |
| 4,584,858 | 4/1986 | Wolter | 70/459 X |
| 4,741,189 | 5/1988 | Battenberg | 70/456 R |
| 4,776,191 | 10/1988 | MacDonald | 70/459 |
| 4,821,543 | 4/1989 | Scungio | 70/456 R |
| 5,031,430 | 7/1991 | Nelson | 70/456 R |
| 5,209,089 | 5/1993 | Nelson | 70/456 R |
| 5,224,366 | 7/1993 | Huang | 70/456 R |
| 5,477,714 | 12/1995 | Bishop | 70/456 R X |

FOREIGN PATENT DOCUMENTS

| | | | |
|---|---|---|---|
| 1482184 | 4/1967 | France | 70/456 R |

*Primary Examiner*—Suzanne Dino
*Attorney, Agent, or Firm*—Robert J. Doherty

[57] ABSTRACT

A key holder for detachably holding a plurality of key rings with a member movable relative to a body to selectively uncover openings to key ring zones.

7 Claims, 3 Drawing Sheets

KEY HOLDER

FIELD

This invention relates to key holders, and more particularly to such key holders in which is provided a capability of separably carrying three key rings.

BACKGROUND

Key holders separably carrying two key rings are well known in the art; in many of such key holders one ring is removable by manually actuating a sliding element, overriding a spring biasing the element in the opposite direction, to uncover a slot through the thus-uncovered opening of which one of the rings may be removed.

PREFERRED EMBODIMENT

The presently preferred embodiment of the invention is shown in the accompanying drawings, in light of which its structure and operation are now described.

DRAWINGS

STRUCTURE

Figure 1:
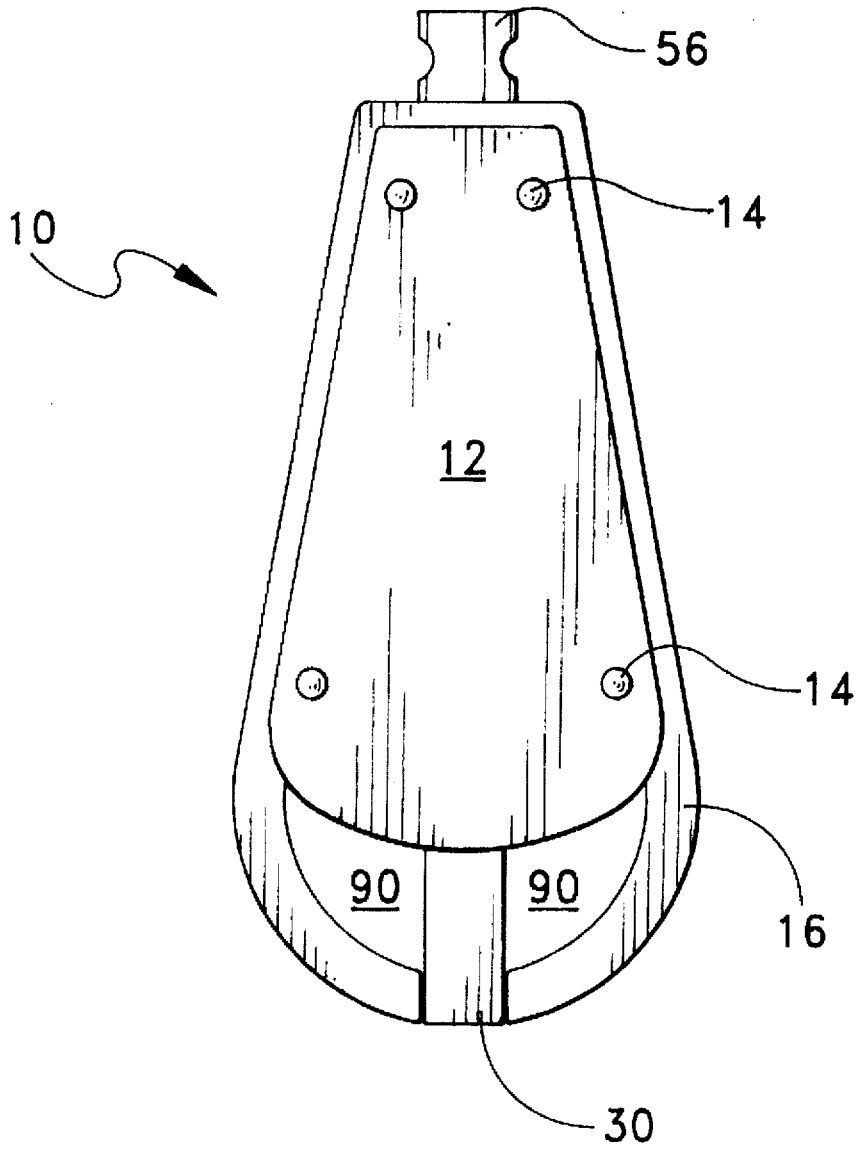
FIG. 1 is a side view of the presently preferred embodiment, with key rings not shown.

The preferred embodiment key holder is indicated generally at 10. In FIG. 1 is shown a side plate 12 secured through four rivets 14 to body 16 and side plate 18, the side plates being held by the rivets against the body therebetween.

Figure 2:
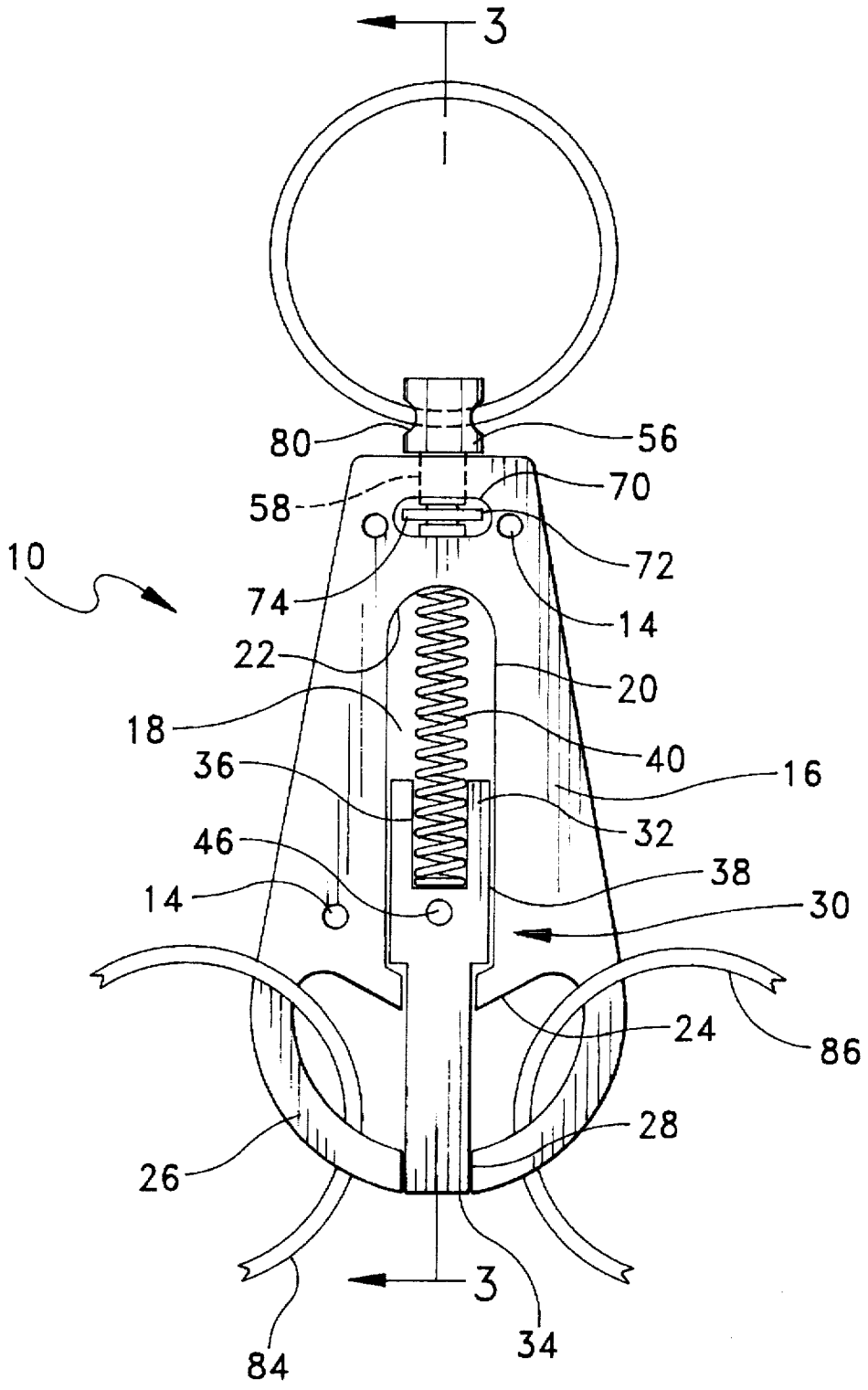
FIG. 2 is an enlarged side elevation view of said embodiment, with one side plate removed and showing key rings.

The body is shown, with side plate 12 removed, in FIG. 2. The body is formed from metal in sheet form about one-sixteenth inch thick, and is of uniform cross-section in all planes parallel to parallel planar side surfaces (which abut side plates 12 and 18, respectively) of body 16. Longitudinally centrally of body 16 is elongated slot made blind in arcuate end 22. The slot is necked down by a pair of inwardly extending protrusions 24, through which slot 20 opens into an overall key zone defined by a wall of circle arc 26 of large diameter and greater than semicircular angular extent, the arc being broken out symmetrically of the body's longitudinal axis to provide an opposed pair of body tips 28.

Figure 3:
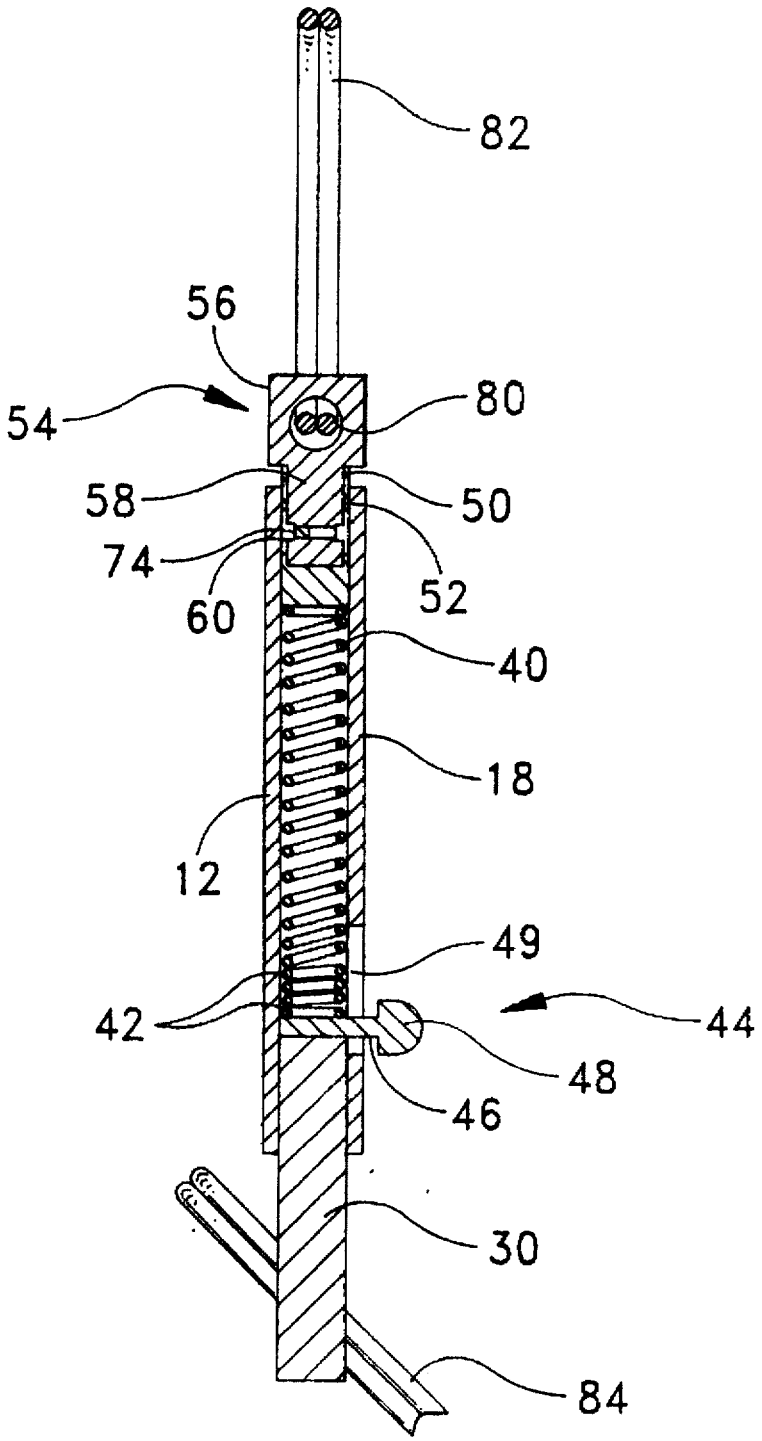
FIG. 3 is a sectional view taken at 3—3 of FIG. 2.

Positioned in slot 20, and between side plates 12 and 18, for free but controlled longitudinal movement relative to body 16, is a forked slide indicated generally at 30 which includes a forked wider end 32 and a narrower end 34. Wide end 32 receives bearing support transversely from slot 20, and in a thickness direction from side plates 12 and 18. Narrow end 34 receives transverse bearing support from protrusions 24 and, intermittently, tips 28. Slide 30 is of metal of thickness corresponding to that of body 16. The longitudinal outer surfaces of the slide wider end 32 are cylindrical, loci of longitudinal lines rotated abut a centerline along the longitudinal axis of slide 30 and body 16 and with a radius just less than the transverse distance between the planar sides of slot 20. The narrow end 34 is of the same thickness as the wider end 32, and of abut the same transverse width as thickness, so as to be abut square in cross-section. Extending inwardly from the end of wide portion 32 is a blind slot 36 with longitudinal walls concentric with outer surfaces 38 and of diameter to accept supportedly for free compression and expansion spring 40 (of which section lines are omitted in FIG. 3), which abuttedly rests against arc 22 and is secured at its other end by lower turns 42 of spring 40, these lower turns having been formed of slightly larger dieter so as to force fittedly interact with the walls of slot 36, to hold turns 42 against longitudinal movement relative to slide 30.

Headed rivet indicated generally at 44 has a stem 46 which is force-fitted into a transverse hole in body 16 and a head 48. Rivet 44 stops short of side plate 12, and is movable relative to side plate 18 in vertical slot 49 of width to slidably accept rivet portion 46.

Extending into hole 50 of body 16, hole 50 having in a body thickness direction very thin walls 52, is a metal connector indicated generally at 54 which has a cylindrical body portion 56 and a cylindrical shank 58 of diameter to slidably fit in hole 50. In shank 58 is annular notch 60.

Extending transversely of notch 60 and slot 70 transversely through body 16 with semicylindrical ends 72 is thin C-shaped sheet metal locking member 74, stopped against significant movement in a body thickness direction by side plates 12 and 18, which are adjacent it.

Extending through transverse hole 80 in connector 54 is a conventional key ring 82 with two turns of helically wound spring wire into which may be inserted keys. Further such rings (both shown broken away in the drawings) 84 and 86 are contained in the key zones 90 defined by arc 26 and slide portion 34.

Operation

The thumb may be used against rivet head 48 to push it upwardly in FIG. 2, to selectively and temporarily override the force in compression of spring 40 holding end 34 in the position shown in FIG. 2 and open for ring removal from key zones 90. This allows removal for separate activity of either or both of key rings 84 and 86.

There is thus provided a device of simple form but with great versatility and utility.

Other Embodiments

Other embodiments within the claims will occur to those in the art.

What is claimed is:

1. A key ring device comprising a longitudinally oriented body having a first forward end and a second rear end, a movable slide member, said movable slide member being slidably mounted within a longitudinally oriented slot in turn provided in said body, said body further having a pair of spaced side plates parallel to each other and in part defining the lateral extent of said slot and in part forming said body, said body including a pair of arms outwardly extending from said first body end, said pair of arms having outer terminal ends positioned in Opposed separation to each other and in part forming an overall key zone with a sole key ring removal opening formed by the space between said opposed outer terminal ends of said arms, said movable slide member being mounted for selective longitudinal movement relative to said body and through said overall key zone and selectively in part defining with said body and said arms a pair of laterally opposed key ring positioning zones, said slide member including a forward terminal end and wherein said slide member is selectively movable between a first position in which said rings positioning zones are closed and a second position in which at least one of said ring positioning zones is open, said slide member terminal end disposed between said arm outer terminal ends in said first closed position so as to block said key ring removal opening and slidably longitudinally retracted at least partially into said body and towards said second body end in said second open position wherein said slide member no longer blocks said key ring removal opening, said slide member biased to said first closed position.

2. The device of claim 1, wherein said two ring positioning zones are simultaneously opened and closed.

3. The device of claim 1 in which said slide member includes a wider end and a narrower end.

4. The device of claim 3 in which said slot includes inwardly extending narrowing protrusions disposed at the forward end of said body which cooperate with said slide member wider end to provide therebetween a stop for relative movement of said slide member toward said first end of said body, said narrowing protrusions adapted to contact and support said slide member.

5. The device of claim 4 in which said slide member includes a longitudinal blind slot positioned toward second end and a spring compressedly mounted between a bottom of said blind slot and an abutting end of said slot toward said second end.

6. The device of claim 1 in which said arms are arcuate centrally outwardly of said first body end.

7. The device of claim 1 in which said body abuts at said second end a connector, said connector including a shank extending through an end portion of said body toward said second end from said slot and including in said shank a groove in general alignment with a transversely extending slot through the thickness of said body, locking means extending in said slot and into said groove.

* * * * *